US010290271B2

(12) United States Patent
Lv

(10) Patent No.: US 10,290,271 B2
(45) Date of Patent: May 14, 2019

(54) DISPLAY PANEL, DISPLAY DEVICE AND DISPLAY METHOD THEREOF

(71) Applicants: BOE TECHNOLOGY GROUP CO., LTD., Beijing (CN); HEFEI BOE OPTOELECTRONICS TECHNOLOGY CO., LTD., Anhui (CN)

(72) Inventor: Lei Lv, Beijing (CN)

(73) Assignees: BOE TECHNOLOGY GROUP CO., LTD., Beijing (CN); HEFEI BOE OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 0 days.

(21) Appl. No.: 15/852,248

(22) Filed: Dec. 22, 2017

(65) Prior Publication Data

US 2018/0308438 A1 Oct. 25, 2018

(30) Foreign Application Priority Data

Apr. 24, 2017 (CN) ..... 2017 1 0270418

(51) Int. Cl.
*G09G 3/36* (2006.01)
*G09G 3/20* (2006.01)

(52) U.S. Cl.
CPC ..... *G09G 3/3607* (2013.01); *G09G 3/3611* (2013.01); *G09G 3/2003* (2013.01); *G09G 2310/0235* (2013.01); *G09G 2320/0686* (2013.01)

(58) Field of Classification Search
CPC ..... G09G 3/3607; G09G 3/3611; G09G 2320/0686; G09G 3/2003; G09G 2310/0235
See application file for complete search history.

(56) References Cited

U.S. PATENT DOCUMENTS

2007/0146344 A1* 6/2007 Martin ..... G06F 1/3215 345/173
2014/0092140 A1* 4/2014 Wadhwa ..... G09G 3/20 345/660
2015/0016641 A1* 1/2015 Ugur ..... G10L 21/0216 381/303

* cited by examiner

*Primary Examiner* — Rodney Amadiz
(74) *Attorney, Agent, or Firm* — Brooks Kushman P.C.

(57) ABSTRACT

A display panel, a display device and a display method thereof are provided. The display method includes: detecting a position of a visual focus at a display panel; allocating sub-pixels outside a predetermined region around the position of a visual focus at a display panel into a first region; generating a conversion image based on a predetermined image, where the predetermined image has predetermined gray scales for the sub-pixels, and the conversion image has conversion gray scales for the sub-pixels; at the first region, the conversion gray scale of one of two adjacent sub-pixels in a row direction is zero, and the conversion gray scale of one of two adjacent sub-pixels in a column direction is zero; in the conversion image, the conversion gray scales and the predetermined gray scales of the sub-pixels outside the first region are identical; and controlling the sub-pixels to display based on the conversion gray scales of the sub-pixels in the conversion image.

15 Claims, 2 Drawing Sheets

DISPLAY PANEL, DISPLAY DEVICE AND DISPLAY METHOD THEREOF

CROSS-REFERENCE TO RELATED APPLICATION

This application claims priority to Chinese Patent Application No. 201710270418.8 filed Apr. 24, 2017, which is incorporated herein by reference in its entirety.

TECHNICAL FIELD

The present disclosure relates to the field of display technology, and in particularly to a display panel, a display device and a display method thereof.

BACKGROUND

The liquid crystal display is a common display manner, which can be applied to the television, the displayer, the cell phone and so on. A liquid crystal display panel includes sub-pixels arranged in an M×N array, and displays in a line-by-line scanning manner. A driving of the liquid crystal display panel is mainly performed by a gate driver and a data driver. The gate driver provides clock signals to turn on the transistor of the driving circuit of each sub-pixel line-by-line, and the data driver charges the sub-pixels through the turned-on transistors, to enable the sub-pixel to display. Generally, the liquid crystal display panel generally displays at a highest definition (i.e., every sub-pixels are lightened). However, a driving power consumption of the displayer may be increased when a size thereof is increased.

SUMMARY

A display method of a display device is provided in the present disclosure, including: detecting a position of a visual focus at a display panel; allocating sub-pixels outside a predetermined region around the position of a visual focus at a display panel into a first region; generating a conversion image based on a predetermined image, where the predetermined image has predetermined gray scales for the sub-pixels, and the conversion image has conversion gray scales for the sub-pixels; at the first region, the conversion gray scale of one of two adjacent sub-pixels in a row direction is zero, and the conversion gray scale of one of two adjacent sub-pixels in a column direction is zero; in the conversion image, the conversion gray scales and the predetermined gray scales of the sub-pixels outside the first region are identical; and controlling the sub-pixels to display based on the conversion gray scales of the sub-pixels in the conversion image.

Optionally, in the conversion image, the conversion gray scale of each sub-pixel in the first region other than the sub-pixels having zero conversion gray scales is determined based on the predetermined gray scale of the sub-pixel and at least one sub-pixel around the sub-pixel and having a color identical to the sub-pixel.

Optionally, the display panel includes a plurality of pixels, and each pixel includes a plurality of sub-pixels of different colors arranged continuously in an identical row; the method further includes: dividing the first region into a plurality of pixel groups, where each pixel group includes two pixels adjacent in a row direction or a column direction; in each pixel group at the first region of the conversion image, the conversion gray scale of each sub-pixel other than the sub-pixels having zero conversion gray scales is determined based on the predetermined gray scale of the sub-pixel and the predetermined gray scales of the sub-pixels having a color identical to the sub-pixel.

Optionally, each pixel group includes two pixels adjacent in the row direction; in the column direction, the first region occupies even number rows of pixels contiguously; in the row direction, the first region occupies an integer number of pixels contiguously.

Optionally, each pixel group includes two pixels adjacent in the row direction; in the row direction, the first region occupies an even number of pixels contiguously.

Optionally, a display panel is further provided in the present disclosure, including: a plurality of sub-pixels arranged in an array form, where the sub-pixels in an identical column have an identical color; a plurality of data lines arranged in a column direction, where each data line is coupled to one sub-pixel in each row, and in the column direction, the sub-pixels coupled to an identical data line are arranged in two adjacent columns alternately; and a controlling sub-circuit, configured to receive a position of a visual focus on the display panel, allocate the sub-pixels outside a predetermined region around the position of the visual focus at a display panel into a first region, and generate a conversion image based on a predetermined image, where the predetermined image has predetermined gray scales for the sub-pixels, and the conversion image has conversion gray scales for the sub-pixels; at the first region, the conversion gray scale of one of two adjacent sub-pixels in the row direction is zero, and the conversion gray scale of one of two adjacent sub-pixels in the column direction is zero, and the controlling sub-circuit is further configured to control the sub-pixels to display based on the conversion gray scales of the sub-pixels in the conversion image; where in the conversion image, the conversion gray scales and the predetermined gray scales of the sub-pixels outside the first region are identical.

Optionally, in the conversion image, the conversion gray scale of each sub-pixel in the first region other than the sub-pixels having zero conversion gray scales is determined based on the predetermined gray scale of the sub-pixel and at least one sub-pixel around the sub-pixel and having a color identical to the sub-pixel.

Optionally, the display panel further includes a plurality of pixels, and each pixel includes a plurality of sub-pixels of different colors arranged continuously in an identical row; the controlling sub-circuit is further configured to divide the first region into a plurality of pixel groups, where each pixel group includes two pixels adjacent in a row direction or a column direction; in each pixel group at the first region of the conversion image, the conversion gray scale of each sub-pixel other than the sub-pixels having zero conversion gray scales is determined based on the predetermined gray scale of the sub-pixel and the predetermined gray scales of the sub-pixels having a color identical to the sub-pixel.

Optionally, in each pixel group at the first region of the conversion image, the conversion gray scale of each sub-pixel other than the sub-pixels having zero conversion gray scales is a mean value of the predetermined gray scale of the sub-pixel and the predetermined gray scales of the sub-pixels having a color identical to the sub-pixel.

Optionally, each pixel group includes two pixels adjacent in the row direction; in the column direction, the first region occupies even number rows of pixels contiguously; in the row direction, the first region occupies an integer number of pixels contiguously.

Optionally, a data line is arranged between two adjacent columns of the sub-pixels, and the sub-pixels coupled to the data line are arranged at two columns of the sub-pixels at both sides of the data line.

Optionally, in each pixel group at the first region of the conversion image, the conversion gray scale of each sub-pixel other than the sub-pixels having zero conversion gray scales is a sum of the predetermined gray scale of the sub-pixel and the predetermined gray scales of the sub-pixels having a color identical to the sub-pixel.

Optionally, each pixel group includes two pixels adjacent in the row direction; in the row direction, the first region occupies an even number of pixels contiguously.

Optionally, a display device including the above display panel is further provided in the present disclosure.

Optionally, the display device further includes an eye tracking sub-circuit configured to detect a position of a visual focus on the display panel and send the position to the controlling sub-circuit.

DRAWING REFERENCES

1-data line, 5-sub-pixel, 6-pixel, 7-pixel group, 91-first region, 92-second region

DETAILED DESCRIPTION

In order to make the objects, the technical solutions and the advantages of the present disclosure more apparent, the present disclosure will be described hereinafter in a clear and complete manner in conjunction with the drawings and embodiments.

Obviously, "row" and "column" are two directions perpendicular to each other. In the present disclosure, an extension direction of the data line refers to a row direction, and a direction perpendicular to the data line refers to a column direction. Therefore, the row and column directions are not related to a shape and an arrangement manner of the display panel.

Figure 1:
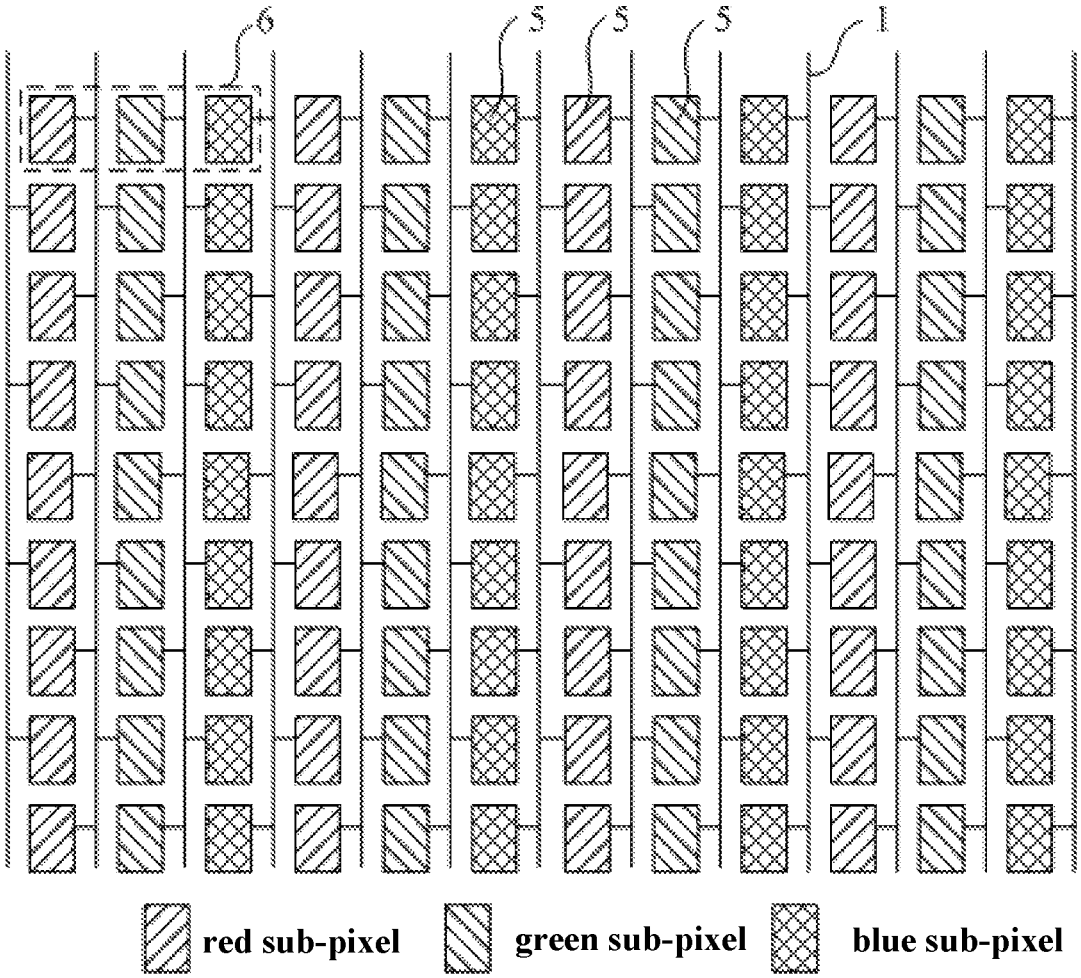
FIG. 1 is a schematic view of a display panel in at least one embodiment of the present disclosure.
Figure 2:
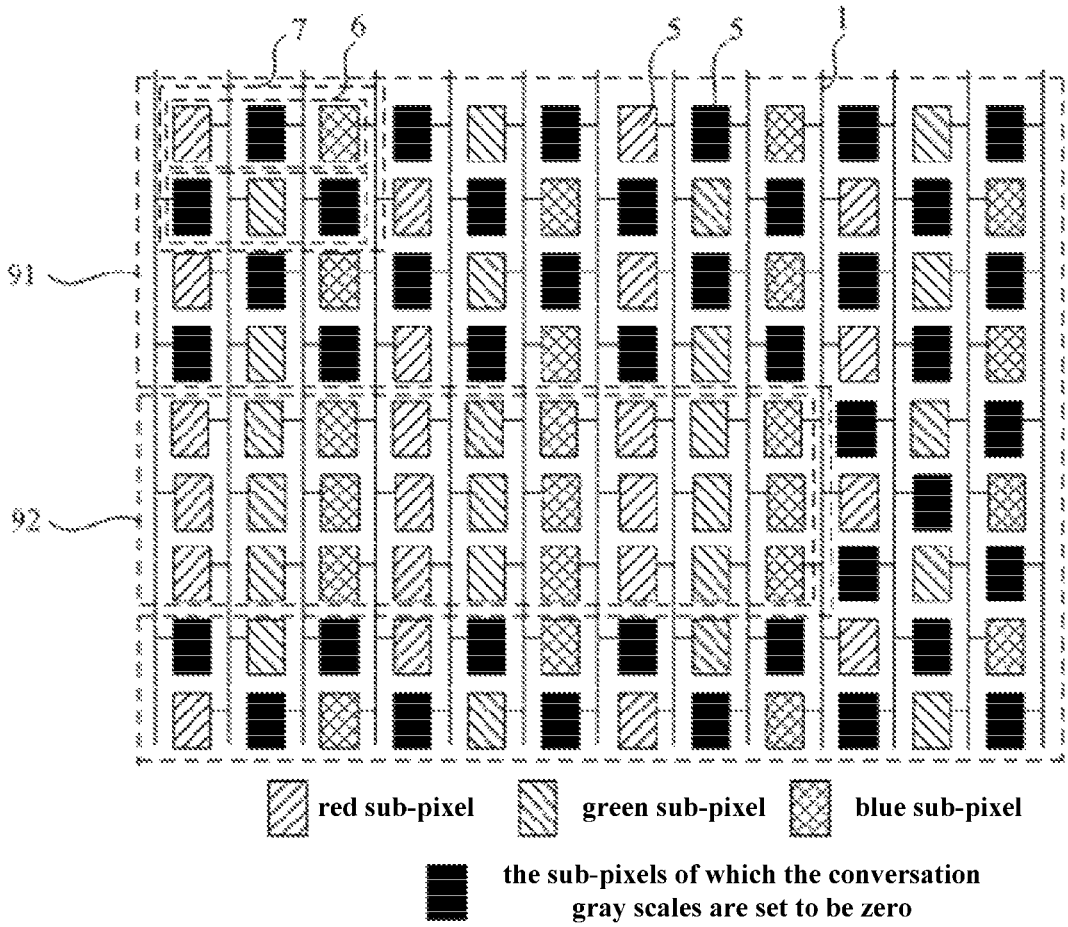
FIG. 2 is a schematic view showing a display state of a display panel in at least one embodiment of the present disclosure.

As shown in FIG. 1 and FIG. 2, a display panel is provided in at least one embodiment of the present disclosure, including: a plurality of sub-pixels 5 arranged in an array form, where the sub-pixels 5 in an identical column have an identical color; a plurality of data lines 1 arranged in a column direction, where each data line 1 is coupled to one sub-pixel 5 in each row, and in the column direction, the sub-pixels 5 coupled to an identical data line 1 are arranged in two adjacent columns alternately;

and a controlling sub-circuit, configured to receive a position of a visual focus on the display panel, allocate the sub-pixels 5 outside a predetermined region around the position of the visual focus at a display panel into a first region 91, and generate a conversion image based on a predetermined image, where the predetermined image has predetermined gray scales for the sub-pixels 5, and the conversion image has conversion gray scales for the sub-pixels 5; at the first region 91, the conversion gray scale of one of two adjacent sub-pixels 5 in the row direction is zero, and the conversion gray scale of one of two adjacent sub-pixels 5 in the column direction is zero. The controlling sub-circuit is further configured to control the sub-pixels 5 to display based on the conversion gray scales of the sub-pixels 5 in conversion image.

As shown in FIG. 1, in the display panel in at least one embodiment of the present disclosure, the data line 1 is coupled to the sub-pixels 5 in adjacent two columns alternately. For example, the data line 1 is coupled to an $m^{th}$, an $(m+2)^{th}$, an $(m+4)^{th}$ . . . rows of sub-pixels 5 in an $N^{th}$ column, and couple to an $(m+1)^{th}$, an $(m+3)^{th}$, an $(m+5)^{th}$ . . . rows of sub-pixels 5 in an $(N+1)^{th}$ column.

Of course, the above sub-pixel 5 includes a driving circuit, and the data line 1 is commonly coupled to the driving circuit. In addition, in order to scan the sub-pixels 5 line by line, the display pane further includes gate lines arranged along a row direction, each electrode line is coupled to the sub-pixels 5 in a row identical to the electrode line (also coupled to the driving circuit of each sub-pixel 5), the detailed description thereof is omitted herein.

Of course, the data line 1 at an outmost edge of the display panel is coupled to the sub-pixels 5 in one column, and the detailed description thereof is omitted herein.

The position of the visual focus refers to a focus of eyes on the display panel. Generally, human eyes may observe a large region at the same time, but the human brain may process the image near the focus. Therefore, the region near the visual focus can be seen by the human eyes best, i.e., the most "clear" region, while the human eyes may see the region far away from the visual focus but not notice the same, i.e., the region far away from the visual focus is a "blurry" region. In at least one embodiment of the present disclosure, the "blurry" region far away from the visual focus is called the first region 91 (or "low-definition" region). Correspondingly, the region near the visual focus is called a second region 92 (or "high-definition" region).

The predetermined image refers to an image generated directly by a driving chipset (e.g., a graphics card), which is the image desired to be displayed when the display panel displays at the highest definition. According to the predetermined image, each sub-pixel 5 has a corresponding predetermined gray scale. In the case that all the sub-pixels 5 display at the predetermined gray scales, the display panel displays the predetermined image.

In at least one embodiment of the present disclosure, the display panel does not display the predetermined image directly. Instead, a conversion image, which has the conversion gray scales of the sub-pixels 5, is generated based on the predetermined image, and then all the sub-pixels 5 display at the conversion gray scales. That is, the display panel displays the conversion image.

However, in the conversion image, the conversion gray scales of a part of the sub-pixels 5 at the first region 91 are set to be zero, that is, no matter what the predetermined gray scales of these sub-pixels 5 in the predetermined image are, the conversion gray scales thereof in the conversion image are zero, and all these sub-pixels 5 display at zero gray scales. The sub-pixels 5 of which the conversion gray scales are set to be zero are arranged at intervals in the row and column directions, so they are arranged in a checkerboard manner.

According to the display panel in at least one embodiment of the present disclosure, a part of the sub-pixels 5 at the first region 91 are set to display at zero gray scale, and these sub-pixels 5 are arranged uniformly in a checkerboard manner. In addition, the first region 91 is far away from the visual focus and cannot be seen clearly, so the display effect may not be adversely affect even though the part of the sub-pixels 5 at the first region 91 are set to display at zero gray scale. In addition, the sub-pixels 5 coupled to an identical data line 1 are arranged in two adjacent columns alternately, so the sub-pixels 5 coupled thereto at the first region 91 are all set to display at zero gray scale. As a result, as long as the data lines 1 are applied the zero gray scale signals, the above display effect may be achieved at the first region 91. In the case that the signals on the data lines 1 are constant, the power consumption may be reduced significantly. Therefore, the power consumption of the above display panel may be reduced without affecting the display effect.

Optionally, the data line 1 is arranged between two adjacent columns of the sub-pixels 5, and the sub-pixels 5 coupled to the data line 1 are arranged at two columns of the sub-pixels 5 at both sides of the data line.

As shown in FIG. 1, the data lines 1 are arranged between every two adjacent columns of the sub-pixels 5 (excepting the data line 1 at the outmost edge), and each data line 1 is coupled to the two columns of the sub-pixels 5 at both sides of the data line 1. As such, the data lines 1 applied by the zero gray scale signals are arranged at intervals.

Optionally, in the conversion image, the conversion gray scales of the sub-pixels 5 outside the first region 91 are identical to the predetermined gray scales thereof.

That is, the conversion gray scales of the sub-pixels 5 at the second region 92 near the visual focus are identical to the predetermined gray scales thereof, i.e., the second region 92 displays at the highest definition, so as to guarantee the best display effect of the "clear" region.

Optionally, in the conversion image, the conversion gray scale of each sub-pixel 5 in the first region 91 other than the sub-pixels 5 having the zero conversion gray scales is determined based on the predetermined gray scale of the sub-pixel 5 and at least one sub-pixel 5 around the sub-pixel and having a color identical to the sub-pixel.

Therefore, the sub-pixels 5 in the first region 91 having the zero conversion gray scales cannot show the predetermined scales thereof, so the display information may be lost. Therefore, the conversion gray scale of each sub-pixel 5 other than the sub-pixels having zero conversion gray scales is determined based on the predetermined gray scales of the nearby pixel sub-pixels 5 (including the sub-pixel 5 itself), so as to show the gray scales as much as possible and reduce the image information loss.

Optionally, the display panel further includes a plurality of pixels 6, and each pixel 6 includes a plurality of sub-pixels 5 of different colors arranged continuously in an identical row, and an arrangement of the sub-pixels 5 in each pixel 6 are the same. The controlling sub-circuit is further configured to divide the first region 91 into a plurality of pixel groups 7, and each pixel group 7 includes two pixels 6 adjacent in a row direction or a column direction. In each pixel group at the first region 91 of the conversion image, the conversion gray scale of each sub-pixel 5 other than the sub-pixels 5 having zero conversion gray scales is determined based on the predetermined gray scale of the sub-pixel 5 and the predetermined gray scales of the sub-pixels having a color identical to the sub-pixel 5.

As shown in FIG. 2, the pixels 6 at the first region 91 are divided into a plurality of pairs. As such, in each pixel group 7, a number of the sub-pixels 5 of each color is two, and it is inevitably that the conversation gray scale of one of the two sub-pixels 5 is set to be zero. Therefore, the conversation gray scale of the other one of the two sub-pixels 5 may be determined based on its own the predetermined gray scale and the predetermined gray scale of the sub-pixel 5 having the zero conversation gray scale.

Optionally, in each pixel group at the first region 91 of the conversion image, the conversion gray scale of each sub-pixel 5 other than the sub-pixels having zero conversion gray scales is a mean value of the predetermined gray scale of the sub-pixel 5 and the predetermined gray scales of the sub-pixels having a color identical to the sub-pixel 5.

That is, the mean value of the predetermined gray scales of two sub-pixels 5 of the same color in the same pixel group 7 is set to be the conversion gray scale of one of the two sub-pixels 5 (the conversion gray scale of the other sub-pixel 5 is set to be zero gray scale). Of course, it is feasible to calculate the conversion gray scales of the sub-pixels 5 by other ways. For example, the sum of the predetermined gray scales of two sub-pixels 5 of the same color in the same pixel group 7 may be set to be the conversion gray scale of one of the two sub-pixels 5, as long as the conversion gray scale does not exceed the maximum gray scale.

Optionally, each pixel group 7 includes two pixels 6 adjacent in the row direction. In the column direction, the first region 91 occupies even number rows of pixels 6 contiguously. In the row direction, the first region 91 occupies an integer number of pixels 6 contiguously.

As shown in FIG. 2, in the case that each pixel group 7 includes two pixels 6 adjacent in the row direction, the first region 91 occupies even number rows of pixels 6 contiguously in the column direction, so as to guarantee that each pixel 6 may be grouped into the corresponding pixel group 7 and facilitate the calculation of the conversion gray scale. In the row direction, the first region 91 the second region 92 both occupy an integer number of pixels 6 contiguously, and there will not be a pixel 6 of which a part belongs to the first region 91 and the other part thereof belongs to the second region 92, thereby facilitating the calculation of the conversion gray scale.

Optionally, each pixel group 7 includes two pixels 6 adjacent in the column direction, and in the row direction, the first region 91 occupies even number rows of pixels 6 contiguously.

Similarly, in the case that each pixel group 7 includes two pixels 6 adjacent in the column direction and the first region 91 occupies even number rows of pixels 6 contiguously in the row direction, every pixels 6 may be grouped into the corresponding pixel groups.

A display device is further provided in at least one embodiment of the present disclosure, including the display panel hereinabove.

That is, it is able to integrate the display panel hereinabove with other components to form a display device. The display device may be any product or component with the display function, such as an electric paper, a cell phone, a tablet PC, a television, a displayer, a laptop computer, a digital photo frame, a navigator.

Optionally, the display device further includes an eye tracking sub-circuit configured to detect a position of a visual focus on the display panel and send the position to the controlling sub-circuit.

That is, the display device may further include an eye tracking sub-circuit configured to detect a position of a visual focus on the display panel and send the position to the controlling sub-circuit, so as to perform the grouping by the controlling sub-circuit. For example, the eye tracking sub-circuit may include a camera on the display panel. The camera may acquire an image of the human eyes and determine the position of the visual focus based on a position and an orientation of the eye balls.

According to the display panel in at least one embodiment of the present disclosure, a part of the sub-pixels 5 at the first region 91 are set to display at zero gray scale, and these sub-pixels 5 are arranged uniformly in a checkerboard manner. In addition, the first region 91 is far away from the visual focus and cannot be seen clearly, so the display effect may not be adversely affect even though the part of the sub-pixels 5 at the first region 91 are set to display at zero gray scale. In addition, the sub-pixels 5 coupled to an identical data line 1 are arranged in two adjacent columns alternately, so the sub-pixels 5 coupled thereto at the first region 91 are all set to display at zero gray scale. As a result, as long as the data lines 1 are applied the zero gray scale signals, the above display effect may be achieved at the first region 91. In the case that the signals on the data lines 1 are constant, the power consumption may be reduced significantly. Therefore, the power consumption of the above display panel may be reduced without affecting the display effect.

As shown in FIG. 1 and FIG. 2, a display method of a display device is provided in at least one embodiment of the present disclosure. The display device includes a display panel, and the display panel includes: a plurality of sub-pixels 5 arranged in an array form, where the sub-pixels 5 in an identical column have an identical color; a plurality of data lines 1 arranged in a column direction, where each data line 1 is coupled to one sub-pixel 5 in each row, and in the column direction, the sub-pixels 5 coupled to an identical data line 1 are arranged in two adjacent columns alternately.

The method includes: receiving a position of a visual focus on the display panel, allocating the sub-pixels 5 outside a predetermined region around the position of the visual focus at a display panel into a first region 91; generating a conversion image based on a predetermined image, where the predetermined image has predetermined gray scales for the sub-pixels 5, and the conversion image has conversion gray scales for the sub-pixels 5; at the first region, the conversion gray scale of one of two adjacent sub-pixels in the row direction is zero, and the conversion gray scale of one of two adjacent sub-pixels in the column direction is zero; and controlling the sub-pixels 5 to display based on the conversion gray scales of the sub-pixels in the conversion image.

Optionally, prior to the receiving a position of a visual focus on the display panel, the method further includes: detecting a position of a visual focus at the display panel.

Optionally, in the conversion image, the conversion gray scales and the predetermined gray scales of the sub-pixels 5 outside the first region 91 are identical.

Optionally, in the conversion image, the conversion gray scale of each sub-pixel 5 in the first region other than the sub-pixels having zero conversion gray scales is determined based on the predetermined gray scale of the sub-pixel 5 and at least one sub-pixel around the sub-pixel and having a color identical to the sub-pixel 5.

Optionally, the display panel further includes a plurality of pixels 6, and each pixel 6 includes a plurality of sub-pixels 5 of different colors arranged continuously in an identical row, and an arrangement of the sub-pixels 5 in each pixel 6 are the same. The display method further includes: dividing the first region 91 into a plurality of pixel groups 7, where each pixel group 7 includes two pixels 6 adjacent in a row direction or a column direction. In each pixel group 7 at the first region 91 of the conversion image, the conversion gray scale of each sub-pixel 5 other than the sub-pixels 5 having zero conversion gray scales is determined based on the predetermined gray scale of the sub-pixel 5 and the predetermined gray scale of the other sub-pixel 5 having a color identical to the sub-pixel 5.

Optionally, each pixel group 7 includes two pixels 6 adjacent in the row direction. In the column direction, the first region 91 occupies even number rows of pixels 6 contiguously, and in the row direction, the first region 91 occupies an integer number of pixels 6 contiguously; or each pixel group 7 includes two pixels 6 adjacent in the row direction, and in the row direction, the first region 91 occupies an even number of pixels 6 contiguously.

According to the display method in at least one embodiment of the present disclosure, a part of the sub-pixels 5 at the first region 91 are set to display at zero gray scale, and these sub-pixels 5 are arranged uniformly in a checkerboard manner. In addition, the first region 91 is far away from the visual focus and cannot be seen clearly, so the display effect may not be adversely affect even though the part of the sub-pixels 5 at the first region 91 are set to display at zero gray scale. In addition, the sub-pixels 5 coupled to an identical data line 1 are arranged in two adjacent columns alternately, so the sub-pixels 5 coupled thereto at the first region 91 are all set to display at zero gray scale. As a result, as long as the data lines 1 are applied the zero gray scale signals, the above display effect may be achieved at the first region 91. In the case that the signals on the data lines 1 are constant, the power consumption may be reduced significantly. Therefore, the power consumption of the above display panel may be reduced without affecting the display effect.

The above are merely the preferred embodiments of the present disclosure. A person skilled in the art may make further modifications and improvements without departing from the principle of the present disclosure, and these modifications and improvements shall also fall within the scope of the present disclosure.

What is claimed is:

1. A display method of a display device, comprising:

detecting a position of a visual focus at a display panel;

allocating sub-pixels outside a predetermined region around the position of a visual focus at a display panel into a first region;

generating a conversion image based on a predetermined image, wherein the predetermined image has predetermined gray scales for the sub-pixels, and the conversion image has conversion gray scales for the sub-pixels; at the first region, the conversion gray scale of one of two adjacent sub-pixels in a row direction is zero, and the conversion gray scale of one of two adjacent sub-pixels in a column direction is zero; in the conversion image, the conversion gray scales and the predetermined gray scales of the sub-pixels outside the first region are identical; and controlling the sub-pixels to display based on the conversion gray scales of the sub-pixels in the conversion image.

2. The method according to claim 1, wherein in the conversion image, the conversion gray scale of each sub-pixel in the first region other than the sub-pixels having zero conversion gray scales is determined based on the predetermined gray scale of the sub-pixel and at least one sub-pixel around the sub-pixel and having a color identical to the sub-pixel.

3. The method according to claim 2, wherein the display panel comprises a plurality of pixels, and each pixel comprises a plurality of sub-pixels of different colors arranged continuously in an identical row;

the method further comprises: dividing the first region into a plurality of pixel groups, wherein each pixel group comprises two pixels adjacent in a row direction or a column direction;

in each pixel group at the first region of the conversion image, the conversion gray scale of each sub-pixel other than the sub-pixels having zero conversion gray scales is determined based on the predetermined gray scale of the sub-pixel and the predetermined gray scales of the sub-pixels having a color identical to the sub-pixel.

4. The method according to claim 3, wherein each pixel group comprises two pixels adjacent in the row direction;

in the column direction, the first region occupies even number rows of pixels contiguously;

in the row direction, the first region occupies an integer number of pixels contiguously.

5. The method according to claim 3, wherein each pixel group comprises two pixels adjacent in the row direction;

in the row direction, the first region occupies an even number of pixels contiguously.

6. A display panel, comprising:

a plurality of sub-pixels arranged in an array form, wherein the sub-pixels in an identical column have an identical color;

a plurality of data lines arranged in a column direction, wherein each data line is coupled to one sub-pixel in each row, and in the column direction, the sub-pixels coupled to an identical data line are arranged in two adjacent columns alternately; and a controlling sub-circuit, configured to receive a position of a visual focus on the display panel, allocate the sub-pixels outside a predetermined region around the position of the visual focus at a display panel into a first region, and generate a conversion image based on a predetermined image, wherein the predetermined image has predetermined gray scales for the sub-pixels, and the conversion image has conversion gray scales for the sub-pixels; at the first region, the conversion gray scale of one of two adjacent sub-pixels in the row direction is zero, and the conversion gray scale of one of two adjacent sub-pixels in the column direction is zero, and the controlling sub-circuit is further configured to control the sub-pixels to display based on the conversion gray scales of the sub-pixels in the conversion image;

wherein in the conversion image, the conversion gray scales and the predetermined gray scales of the sub-pixels outside the first region are identical.

7. The display panel according to claim 6, wherein in the conversion image, the conversion gray scale of each sub-pixel in the first region other than the sub-pixels having zero conversion gray scales is determined based on the predetermined gray scale of the sub-pixel and at least one sub-pixel around the sub-pixel and having a color identical to the sub-pixel.

8. The display panel according to claim 7, further comprising a plurality of pixels, and each pixel comprises a plurality of sub-pixels of different colors arranged continuously in an identical row;

the controlling sub-circuit is further configured to divide the first region into a plurality of pixel groups, wherein each pixel group comprises two pixels adjacent in a row direction or a column direction;

in each pixel group at the first region of the conversion image, the conversion gray scale of each sub-pixel other than the sub-pixels having zero conversion gray scales is determined based on the predetermined gray scale of the sub-pixel and the predetermined gray scales of the sub-pixels having a color identical to the sub-pixel.

9. The display panel according to claim 8, wherein in each pixel group at the first region of the conversion image, the conversion gray scale of each sub-pixel other than the sub-pixels having zero conversion gray scales is a mean value of the predetermined gray scale of the sub-pixel and the predetermined gray scales of the sub-pixels having a color identical to the sub-pixel.

10. The display panel according to claim 8, wherein each pixel group comprises two pixels adjacent in the row direction;

in the column direction, the first region occupies even number rows of pixels contiguously;

in the row direction, the first region occupies an integer number of pixels contiguously.

11. The display panel according to claim 6, wherein a data line is arranged between two adjacent columns of the sub-pixels, and the sub-pixels coupled to the data line are arranged at two columns of the sub-pixels at both sides of the data line.

12. The display panel according to claim 8, wherein in each pixel group at the first region of the conversion image, the conversion gray scale of each sub-pixel other than the sub-pixels having zero conversion gray scales is a sum of the predetermined gray scale of the sub-pixel and the predetermined gray scales of the sub-pixels having a color identical to the sub-pixel.

13. The display panel according to claim 8, wherein each pixel group comprises two pixels adjacent in the row direction;

in the row direction, the first region occupies an even number of pixels contiguously.

14. A display device comprising the display panel according to claim 6.

15. The display device according to claim 14, further comprising an eye tracking sub-circuit configured to detect a position of a visual focus on the display panel and send the position to the controlling sub-circuit.

* * * * *